US006079786A

United States Patent [19]

Kirkland et al.

[11] Patent Number: 6,079,786

[45] Date of Patent: Jun. 27, 2000

[54] ONE-SHOT PEDESTAL SWIVEL SEAT LOCK/RELEASE MECHANISM

[75] Inventors: Rex Allen Kirkland, Lancaster; Bobby Leo Woodward, Mabank, both of Tex.

[73] Assignee: Brunswick Corporation, Lake Forest, Ill.

[21] Appl. No.: 09/008,665

[22] Filed: Jan. 16, 1998

Related U.S. Application Data

[63] Continuation-in-part of application No. 08/852,592, May 7, 1997, abandoned.

[51] Int. Cl.[7] ..... A47C 3/30

[52] U.S. Cl. ..... 297/344.24; 297/344.19; 297/344.22; 297/344.13; 248/416; 248/425

[58] Field of Search ..... 297/344.19, 344.22, 297/463.1, 302.2, 344.1, 344.13, 344.24; 292/61; 248/424, 416

[56] References Cited

U.S. PATENT DOCUMENTS

| | | | |
|---|---|---|---|
| 701,238 | 5/1902 | Williams . | |
| 1,966,205 | 7/1934 | Johnson . | |
| 2,054,557 | 9/1936 | Cramer et al. . | |
| 2,787,315 | 4/1957 | Siebert . | |
| 2,909,247 | 10/1959 | Romito . | |
| 3,158,387 | 11/1964 | Martin . | |
| 3,307,820 | 3/1967 | Martin . | |
| 3,622,202 | 11/1971 | Brown | 248/429 X |
| 3,659,895 | 5/1972 | Dresden | 248/425 X |
| 3,674,308 | 7/1972 | Radding | 297/344.21 X |
| 3,740,014 | 6/1973 | Swenson et al. | 248/429 X |
| 3,756,654 | 9/1973 | Bauer . | |
| 3,848,921 | 11/1974 | Rhodes . | |
| 3,853,298 | 12/1974 | Libkie et al. | 248/429 |
| 3,858,834 | 1/1975 | Eimen . | |
| 3,885,764 | 5/1975 | Pabreza . | |
| 3,950,027 | 4/1976 | Wilson | 248/118 X |
| 4,113,221 | 9/1978 | Wehner | 292/61 X |
| 4,408,800 | 10/1983 | Knapp . | |
| 4,518,139 | 5/1985 | Barfell . | |
| 4,587,921 | 5/1986 | Currey . | |
| 4,660,885 | 4/1987 | Suhr et al. | 248/429 X |
| 4,673,155 | 6/1987 | Binder . | |
| 4,756,496 | 7/1988 | Hosan et al. . | |
| 4,779,925 | 10/1988 | Heinzel . | |
| 4,865,283 | 9/1989 | Parker . | |
| 5,129,702 | 7/1992 | Ervin | 248/429 X |
| 5,253,922 | 10/1993 | Corlett . | |
| 5,568,960 | 10/1996 | Oleson et al. . | |
| 5,634,537 | 6/1997 | Thorn | 297/344.22 X |
| 5,704,729 | 1/1998 | Carnahan et al. | 297/344.24 X |
| 5,720,462 | 2/1998 | Brodersen | 297/311 X |

FOREIGN PATENT DOCUMENTS

| | | | |
|---|---|---|---|
| 0 549 026 A1 | 6/1993 | European Pat. Off. . | |
| 1016802 | 4/1950 | France . | |
| 645 643 | 12/1976 | Russian Federation . | |
| 409792 | 5/1934 | United Kingdom | 248/425 |
| 1434127 | 5/1976 | United Kingdom . | |

*Primary Examiner*—Peter M. Cuomo
*Assistant Examiner*—David E Allred
*Attorney, Agent, or Firm*—Duane, Morris & Heckscher LLP

[57] ABSTRACT

A pedestal assembly for a boat seat is disclosed which combines in a single lever adjustment the ability to raise and lower the seat as well as to lock or unlock the seat to permit clockwise and counterclockwise swivel action, as well as moving the seat fore and aft with respect to the pedestal. The lever is pulled up for vertical adjustments up or down. The lever is pushed down facilitating clockwise or counterclockwise pivoting about the pedestal of the seat. When the lever is released it is spring-biased to a neutral position. Depending on the configuration, the seat can be locked in one or more swivelled positions about the pedestal. The seat can be easily moved fore and aft with respect to the pedestal through the lever

18 Claims, 6 Drawing Sheets

ONE-SHOT PEDESTAL SWIVEL SEAT LOCK/RELEASE MECHANISM

This application is a continuation-in-part of application Ser. No. 08/852,592, filed on May 7, 1997 abandoned.

FIELD OF THE INVENTION

The field of this invention relates to pedestal supports, particularly supports useful for boat chairs which incorporate height and swivel control.

BACKGROUND OF THE INVENTION

Height-adjustable pedestal chairs have been in existence for many years. Some prior designs have incorporated adjustment for tilting of the back of the chair, while others have incorporated fairly complex assemblies of cranks or levers to make the individual adjustments. Typical of some of these prior designs for pedestals for adjustable chairs are U.S. Pat. Nos. 2,909,247; 3,756,654; 3,848,921; 4,673,155; 4,779,925; and 5,253,922.

One of the things that the prior designs have not incorporated is a simple adjustable pedestal that allows for height adjustments up or down, as well as an ability to permit swiveling clockwise or counterclockwise about the pedestal, and locking the position of the seat in a variety of positions, as well as translation of the seat fore and aft with respect to the pedestal, in a manner that is accomplished through the use of a unitary lever. Thus, one of the objectives of the present invention is to provide such a simple design where a single lever is useful in allowing height adjustments up or down as well as swivel motions clockwise or counterclockwise, coupled with locking the chair in one or more different swivel positions, and moving the chair fore and aft with respect to the pedestal. Another objective of the invention is to allow for translation fore and aft of the seat with respect to the pedestal, using the same lever as for the other functions.

SUMMARY OF THE INVENTION

A pedestal assembly for a boat seat is disclosed which combines in a single lever adjustment the ability to raise and lower the seat as well as to lock or unlock the seat to permit clockwise and counterclockwise swivel action, as well as moving the seat fore and aft with respect to the pedestal. The lever is pulled up for vertical adjustments up or down. The lever is pushed down facilitating clockwise or counterclockwise pivoting about the pedestal of the seat. When the lever is released it is spring-biased to a neutral position. Depending on the configuration, the seat can be locked in one or more swivelled positions about the pedestal. The seat can be easily moved fore and aft with respect to the pedestal through the lever.

DETAILED DESCRIPTION OF THE PREFERRED EMBODIMENT

Figure 2:
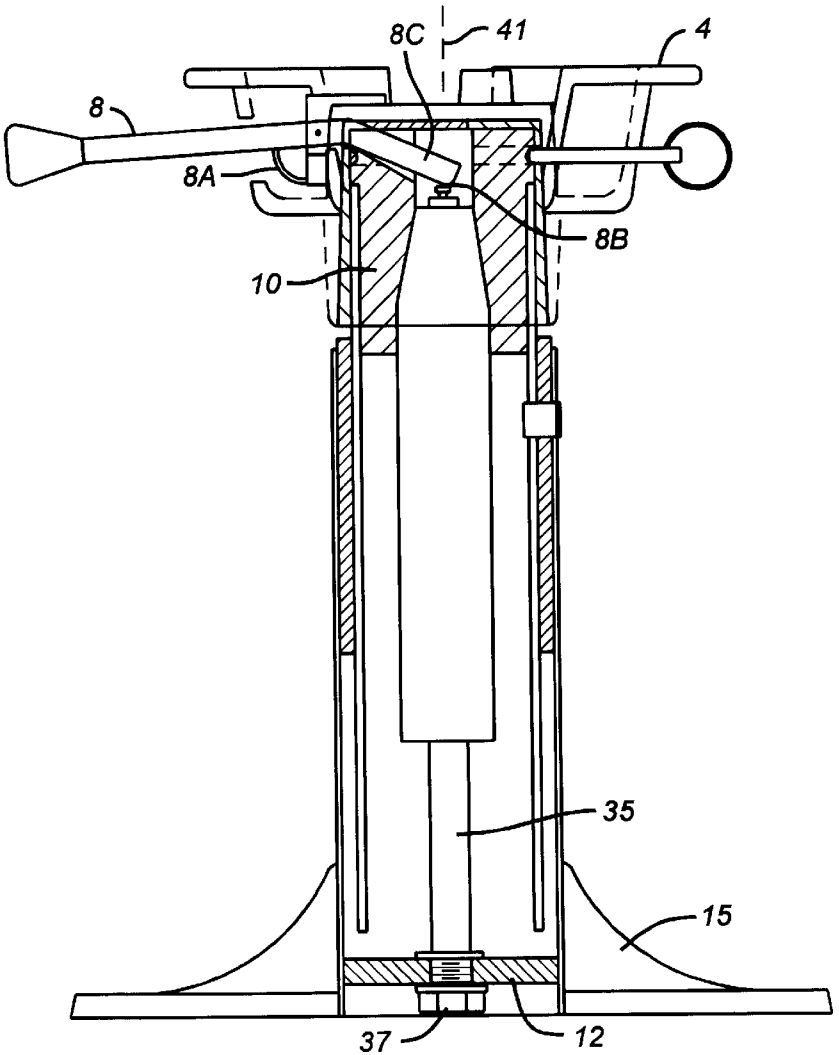
FIG. 2 is a sectional elevational view of the pedestal of the present invention with the lever in the neutral position.
Figure 1:
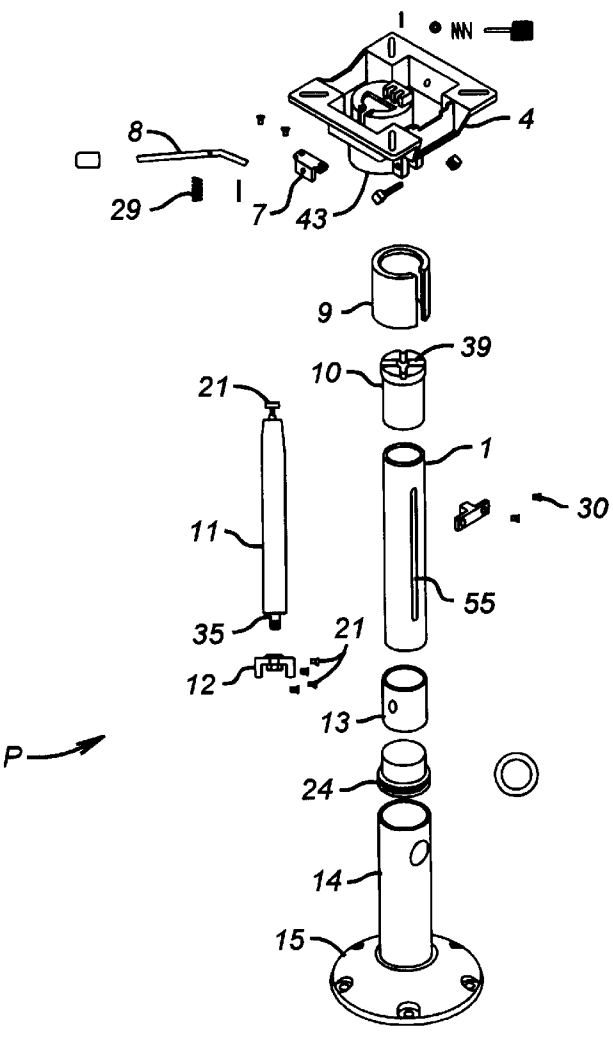
FIG. 1 is an exploded view of the pedestal of the present invention.

The pedestal assembly P is shown in FIG. 1 in exploded view. There a base 15 supports an outer tube 14. A power cylinder base 12 (see FIG. 2 for its location) supports a gas-filled power cylinder 11 within sliding inner tube 1. The power cylinder 11 has a piston 35 which is connected to power cylinder base 12 as shown in FIG. 2. The power cylinder base 12 is secured by fasteners to the base 15 and the piston 35 is secured by nut 37 to power cylinder base 12.

Figure 4:
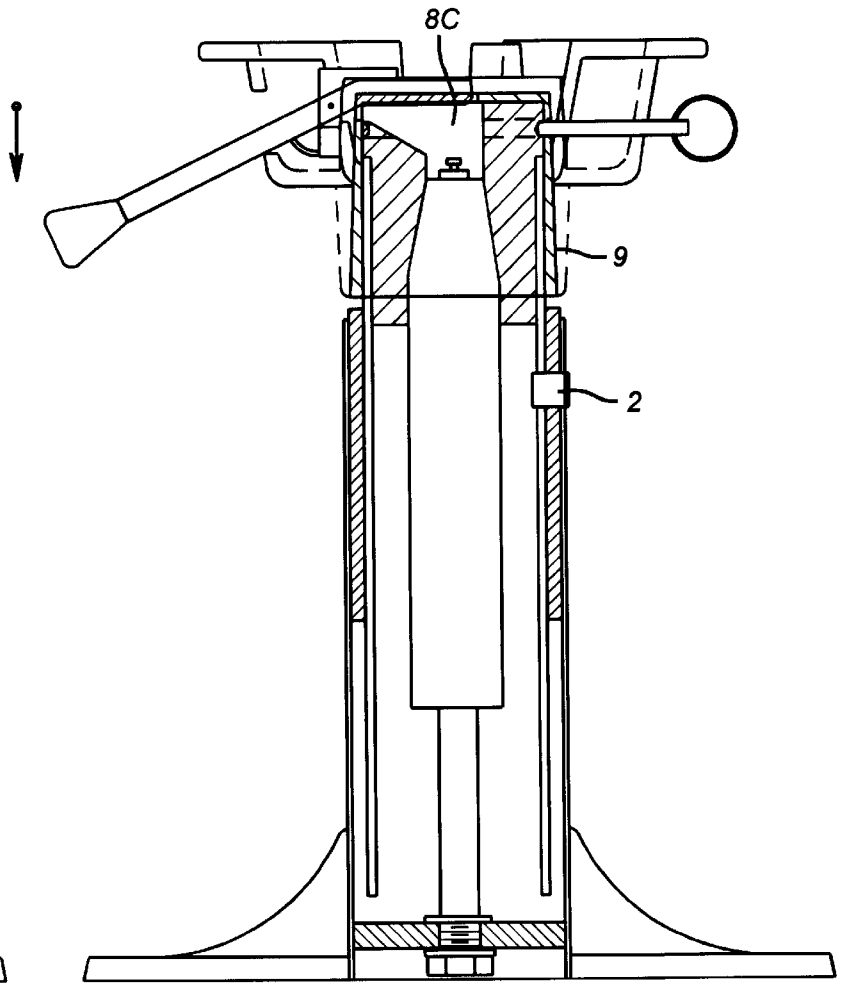
FIG. 4 is the view of FIG. 2 with the lever in the down position.

As shown in FIG. 2, handle 8 extends through the seat mount 4 and through handle pivot hole 7 (see FIG. 1). The end 8C is bent so that in the neutral position shown in FIG. 2, it extends into one of several grooves 39 in locking insert 10. As shown in FIG. 1, locking insert 10 has four grooves disposed at 90°; however more or fewer grooves can be used at different orientations without departing from the spirit of the invention from the spirit of the invention. Locking insert 10 is secured to sliding inner tube 1. In the neutral position of FIG. 2 with the end 8C of the handle 8 extending into one of the grooves 39, the seat mount 4 is precluded from rotating in a horizontal plane about longitudinal axis 41. In order to allow the seat mount 4, which supports the seat (not shown) to rotate in an horizontal plane about axis 41, the lever 8 must be pushed downwardly as shown in FIG. 4. When this occurs, the bent end 8C lifts up out of one of the grooves 39 of locking insert 10, thereby allowing the seat mount 4 to rotate with respect to locking insert 10. As shown in FIGS. 7–10, this motion can also translate the seat (not shown) with respect to the seat mount 4.

Figure 3:
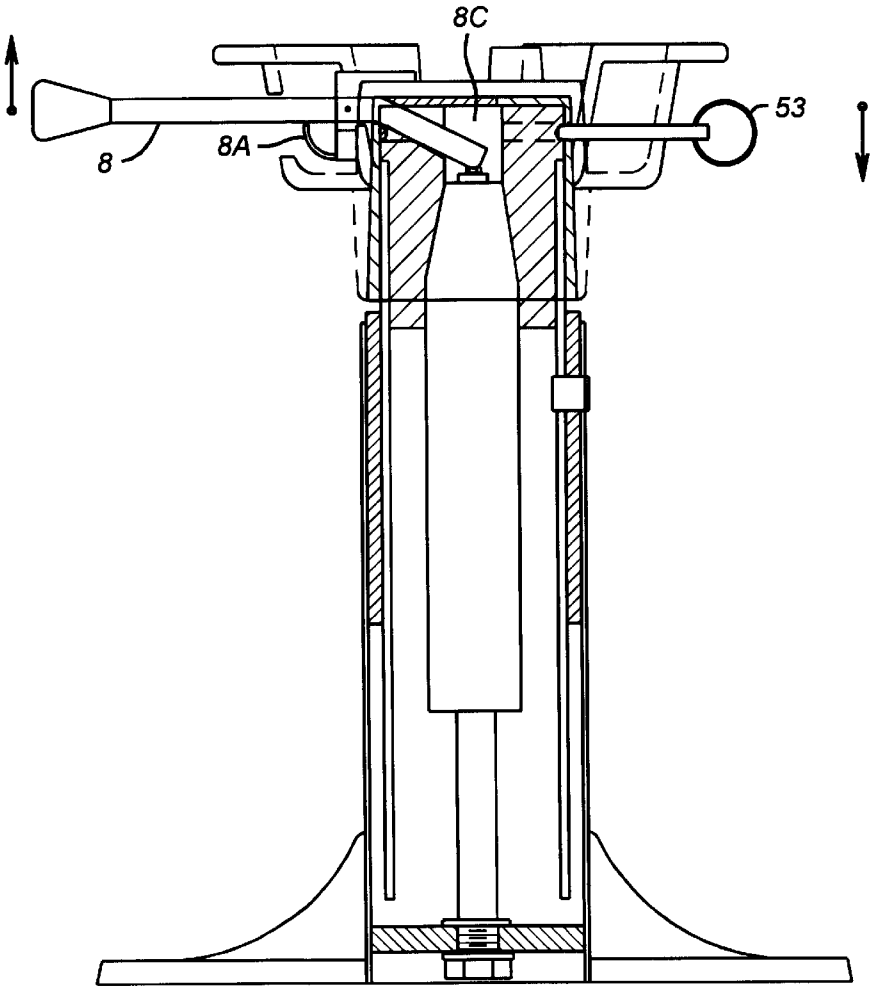
FIG. 3 is the view of FIG. 2 with the lever in the up position.

With an upward pull of lever 8 as shown in FIG. 3, the vertical height of the seat mount 4 can be adjusted. When the handle 8 is pulled upwardly as shown in FIG. 3, the bent component 8C of handle 8 contacts the actuating pin 21 of cylinder 11 and forces it down. The movement of pin 21 can be readily seen by comparing the neutral position of FIG. 2, where the tip 8B is in contact but not pushing on actuating pin 21, and FIG. 3, where tip 8B is depressing pin 21. In the position shown in FIG. 3, the seat mount 4 can be raised or lowered as desired to an appropriate position, and leaf spring 8A (which can be a torsion spring or any other kind of spring) can be used as shown in FIG. 2 to return the lever 8 to its neutral position. Thus, when the lever 8 is released from the position shown in FIGS. 3 or 4, it can return to the position shown in FIG. 2. If, when lever 8 is released, the end 8C is not in alignment with a groove 39, the seat mount 4 can rotate clockwise or counterclockwise until end 8C aligns with a groove 39, at which time spring 8A will bias handle 8 to the neutral position.

The seat mount 4 has a tubular body 43 which is secured by bolt 6 and nut 5 over bushing 9. Bushing 9 fits rotatably over inner tube 1.

Figure 6:
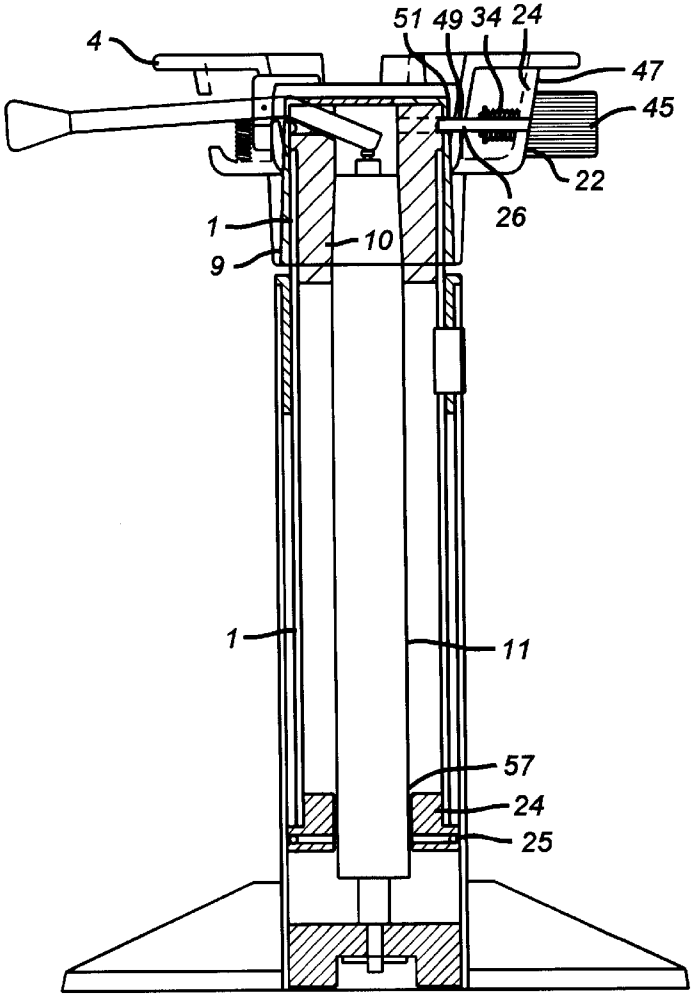
FIG. 6 is the view of FIG. 2 with an alternative disconnect to the pull pin shown in FIG. 2.

Referring to FIG. 6, knob 45 has a slanted surface 22, which when aligned with wall 47 of seat mount 4 allows plunger 26 to extend through opening 49 in seat mount 4 and through a groove 51 in locking insert 10. As previously stated, latching insert 10 is secured inside inner tube 1. Plunger 26 goes into groove 51 in insert 10. Groove 51 extends out beyond the end of inner tube 1. The plunger 26 also goes through an opening (not shown) in bushing 9, which is secured within the tubular body 43 of seat mount 4. In the position shown in FIG. 6, with the plunger 26 extending into groove 51 of locking insert 10, the seat mount 4 cannot be removed. However, 90° rotation of knob 45 retracts the plunger 26 against the bias of spring 34, allowing the seat mount 4 to be removed off of the locking insert 10. FIG. 3 shows the same concept, however, using a pin 53 which is manually inserted or removed from groove 51 in locking insert 10 to selectively secure or release the seat mount 4 to the locking insert 10. It can have a chain on it to prevent its loss.

Figure 5:
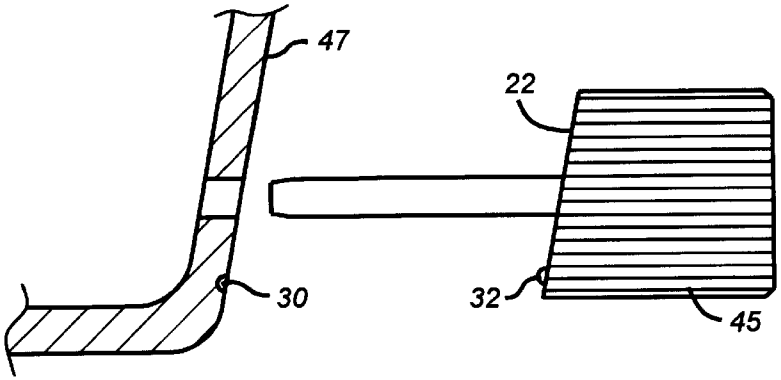
FIG. 5 is a detailed view of the release knob shown in FIG. 6, indicating how the feedback feature operates that tells the fisherman that the seat mount is firmly latched to the pedestal.

FIG. 5 shows a detail of the knob 45 and plunger 26 illustrated in FIG. 6. The biasing spring 34, which is affixed to the plunger 26, keeps the knob 45 from becoming disconnected with the seat mount 4. FIG. 5 illustrates in more detail knob 45 showing the slanted surface 47 which has a projection 32 thereon. FIG. 5 is in exploded view with the spring 34 removed for clarity. It can be seen that the fully extended position of the plunger 26 is defined by alignment of surface 47 with surface 29. When those two surfaces align, the projection 32 will align with the depression 30. The fisherman will feel or hear an audible click when this occurs to alert him or her that the plunger 26 is fully extended and the seat (not shown) and the seat mount 4 are fully secured to locking insert 10. Although one set of a projection 32 and matching depression 30 is shown in FIG. 5, additional numbers of projections 32 and depressions 30 can be used without departing from the spirit of the invention from the spirit of the invention. Other comparable techniques to the projection and depression can also be used so that the operator can have audible or physical feedback that the plunger 26 is fully extended and secures the seat mount 4 to the sliding inner tube 1. While the designs in FIGS. 5 and 6 can be used to hold the chair to the seat mount 4, the preferred embodiment in FIGS. 7–10 integrates this function to lever 8 so it controls foreward and aft movement of the chair as well as the prior-described functions.

Those skilled in art will appreciate that depressing pin 21 results in an extension of piston 35, which raises up or allows lowering of the sliding inner tube 1 and along with it the locking insert 10 and finally the seat mount 4. Applying a downward force to the seat mount 4, with the lever 8 in the up position as shown in FIG. 3, allows the cylinder 11 to move downwardly over the piston 35 so that the elevation of the seat mount 4 is reduced.

Thus, with the lever 8 moved upwardly as shown in FIG. 3, the height of the pedestal is adjusted. That same lever 8 moved downwardly pulls out end 8C from one of the grooves 39 to allow rotation of seat mount 4 with lever 8 about longitudinal axis 41. Rotation about a horizontal plane perpendicular to longitudinal axis 41 can stop with the end 8C not fully situated within the groove 39. The seat mounted to the seat mount 4 can in that condition rotate about the longitudinal axis 41 in either a clockwise or counterclockwise direction until such time that the end 8C comes back into alignment with one of the grooves 39. At that time, the spring 8A biases the end 8C into groove 39 to lock the seat mount 4 against rotation clockwise or counterclockwise.

The sliding inner tube 1 has an elongated slot 55 into which extends inner/outer tube lock 2 so as to retain the outer tube 14 to the inner tube 1 and to rotationally lock them together. Located at the top of outer tube 14 is inner/outer tube bushing 13. A closure 24 accepts an O-ring seal 25 to define the lower end 57 of the cylinder 11.

Thus, in a single lever 8, a control is presented for raising and lower the seat mount 4 which supports the seat (not shown), as well as regulation of clockwise or counterclockwise rotation of the seat mount 4 and foreward and aft movement of the seat with respect to the pedestal P. A mere upward pull on the lever 8 allows for vertical adjustment, while a downward push permits horizontal, clockwise or counterclockwise rotation about a vertical axis 41, as a retention mechanism as shown in FIGS. 7–10 secures the seat mount 4 until it is deliberately defeated by rotation of knob 45 with an upward pull given to the seat. This results in the seat (not shown) with the seat mount 4 and bushing 9 coming off of inner tube 1 as detent or plunger 26 comes out of not only the locking insert 10 but also the sliding inner tube 1 which surrounds the locking insert 10.

Figure 7:
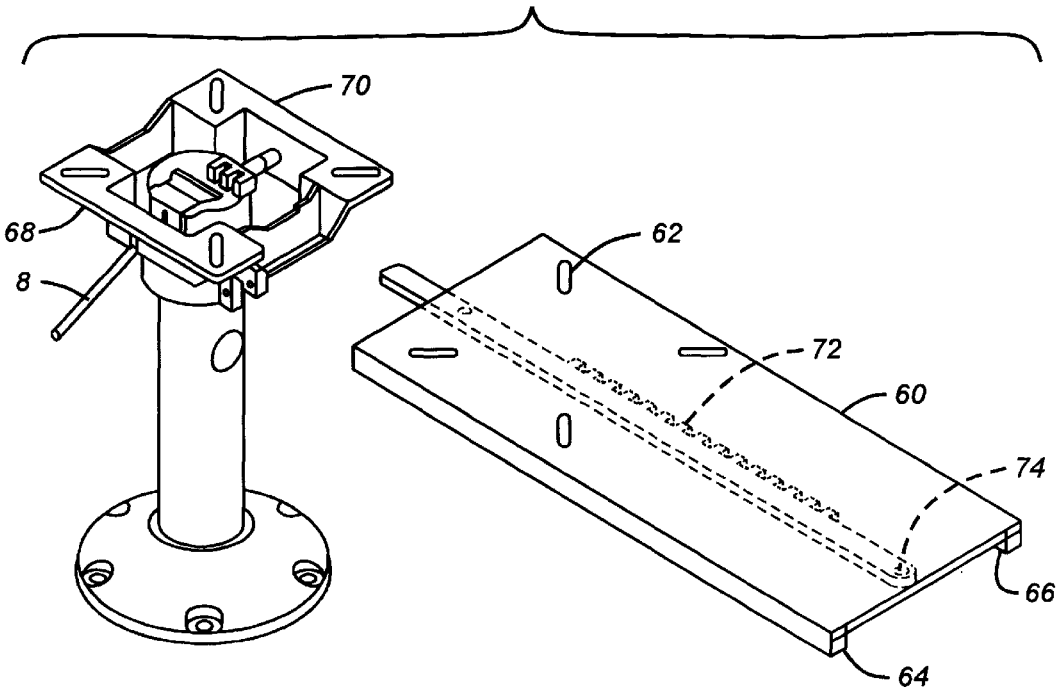
FIG. 7 is an exploded view of the preferred embodiment.
Figure 10:
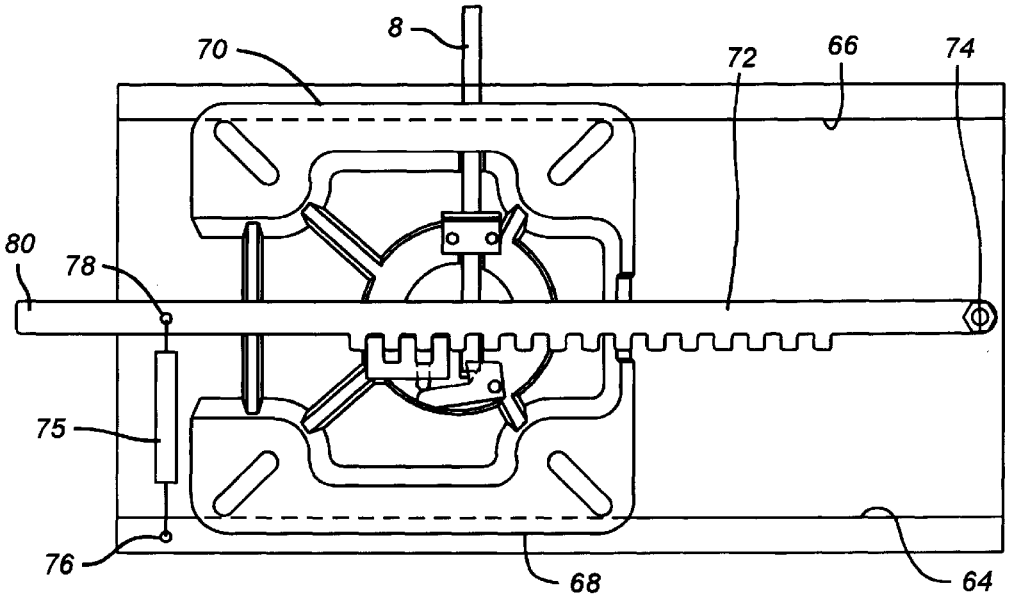
FIG. 10 is a plan view looking through the slider bracket 60 so that the details of the attachment can be seen.

The use of lever 8 to also accomplish the function of moving the seat (not shown) fore and aft with respect to the seat mount 4 is illustrated in FIG. 7. In FIG. 7, a slider bracket 60 accepts the seat (not shown). The openings 62 are used to connect the slider bracket 60 to the seat (not shown). Their position with respect to the slider bracket 60 can be varied without departing from the spirit of the invention to accommodate the particular design of the seat (not shown). The slider bracket 60 has a pair of opposed grooves 64 and 66 which, in turn, catch edges 68 and 70, respectively, on seat mount 4. As seen in FIGS. 7 and 10, the underside of the slider bracket 60 has a locking lever 72 which is pivotally mounted at pin 74. The way the parts are assembled, pin 74, when it contacts seat mount 4, represents the forward travel stop position for the seat, i.e., closest to the boat controls. The view in FIG. 10 is a plan view looking through the slider bracket 60 so that the details of the attachment can be seen. As shown in FIG. 10, the grooves 64 and 66 have been slid over edges 68 and 70, respectively.

The lever 72 is spring-loaded by virtue of spring 75, one end of which is mounted to slider bracket 60 at point 76, and the other end connected to the lever 72 and point 78.

Figure 8:
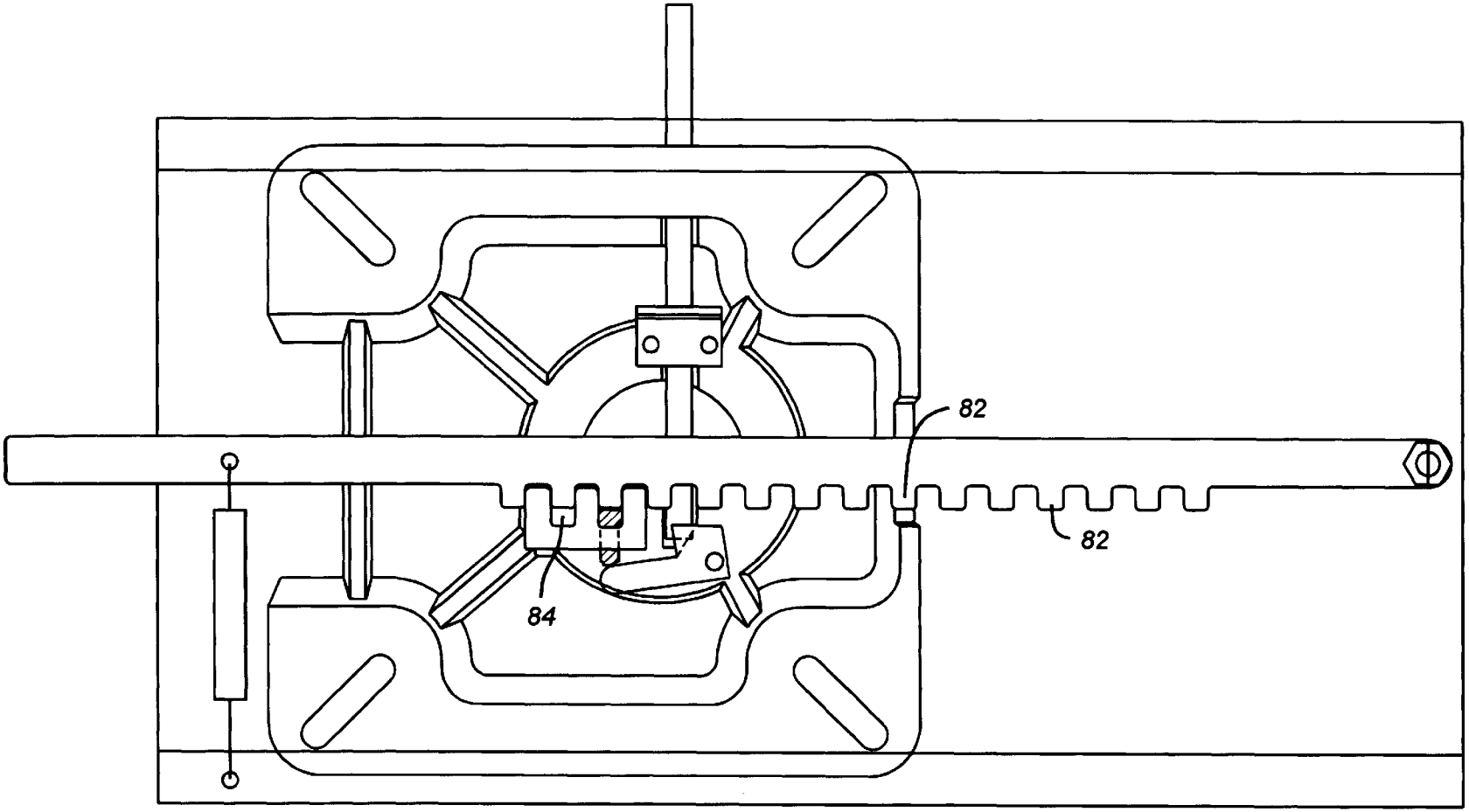
FIG. 8 is a plan view showing the seat connected to the pedestal.
Figure 9:
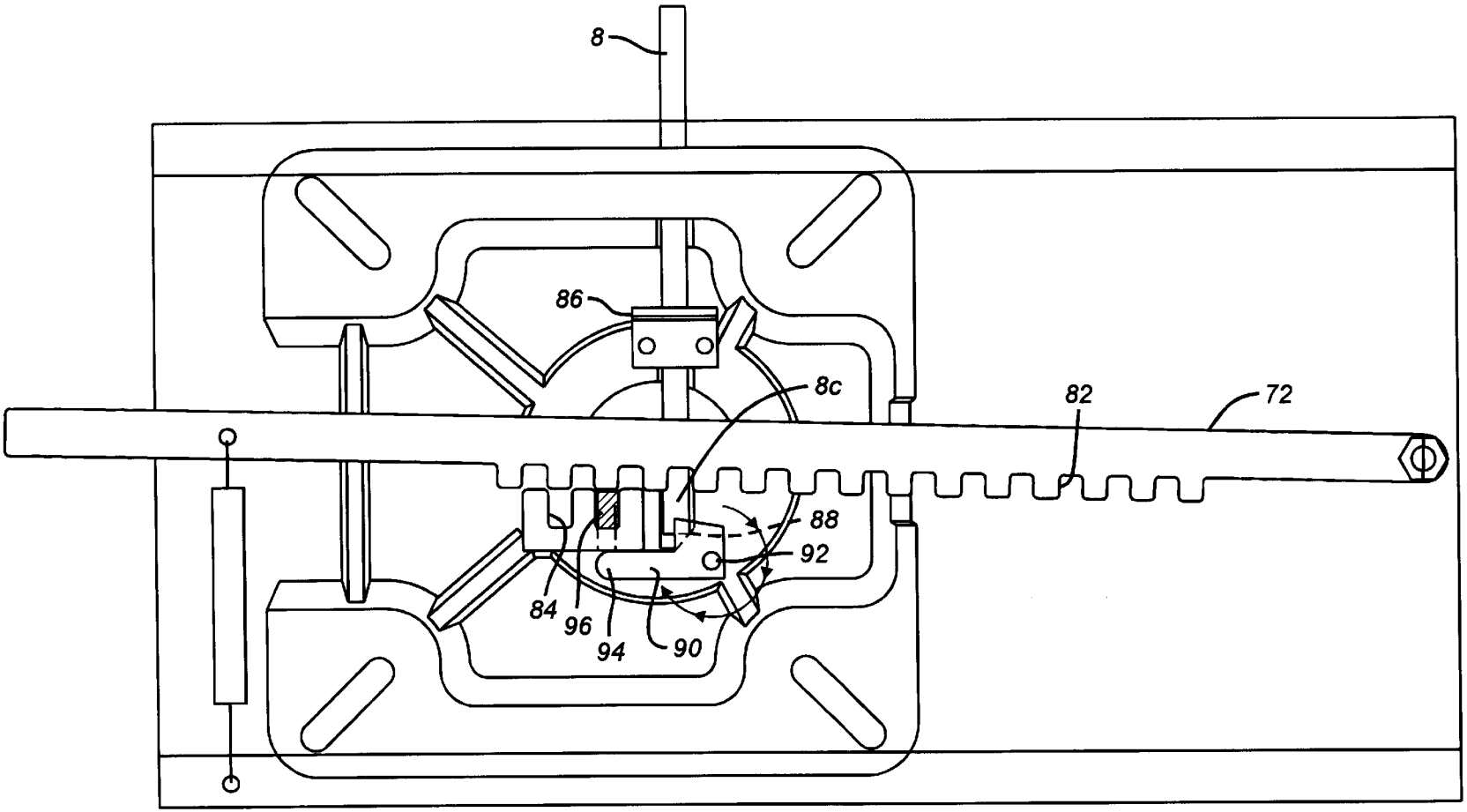
FIG. 9 is a plan view of FIG. 8 in the seat adjusting position.

Optionally, the lever 72 can include an extension segment 80 which is accessible when sitting in the seat (not shown) for facilitating forward and aft movement with respect to the pedestal P. Thus, one way to slide the slider bracket 60 with respect to the seat mount 4 is to operate the extension segment 80 in a clockwise direction, which in turn moves the locking teeth 82 away from engagement grooves 84 such as into the position shown in FIG. 9. With the extension segment 80 so operated, the slider bracket 60 easily slides with respect to the seat mount 4. When the extension segment 80 is released, the teeth 82 fall into the engagement grooves 84, thereby securing the slider bracket 60 to the seat mount 4. Another way to translate the slider bracket 60 with respect to the seat mount 4 can be accomplished by operating the lever 8. This is better seen in the detailed view of FIGS. 8 and 9. In FIG. 8, the slider bracket 60 is already engaged in seat mount 4 since the locking teeth 82 are in engagement grooves 84. Lever 8 pivots about pivot 86 such that when it is pushed down or into the plane of the paper, end 8C engages tapered surface 88 of cam 90, which is in turn pivoted around pivot 92. Cam 90 has an end 94 which engages a plunger 96 whose length exceeds the depth of engagement grooves 84 such that when plunger 96 is pushed outwardly or out of the plane of the paper, it enters the engagement grooves 84 and pushes the locking lever 72 in a clockwise direction to disengage the teeth 82 out of the engagement grooves 84. With the lever 8 pushed downwardly a sufficient distance, the seat with the slider bracket 60 can be translated with respect to the seat mount 4 between two travel stops. Pin 74 is the forward movement travel stop, while a bend in lever 80 (not shown), which engages the seat mount 4, is the travel stop for the rearward movement of the chair. For installation, the slider bracket 60 is placed in position with the lever 8 depressed a sufficient distance. As the teeth 82 line up with the grooves 84, the lever 8 is released and, as previously described, moves back to its neutral position. It should be noted that a lesser movement downwardly (or toward base 15) is required to allow the swivel function, while a continued movement in the downward direction effectuates the movement of the plunger 96 to allow movement of the slider bracket 60 with respect to the seat mount 4.

While an engagement mechanism of teeth and grooves with a plunger release has been illustrated, those skilled in the art will appreciate that other types of engagement devices can be used to secure the slider bracket 60 to the seat mount 4 without departing from the spirit of the invention. It is thus seen that in the preferred embodiment, the lever 8 controls the height of the seat, the swivel function, as well as the translation of the seat with the slider bracket 60 with respect to the pedestal assembly P. It is also within the scope of the invention to include any combination of two functions previously described for lever 8, as well as all three, as illustrated in the preferred embodiment. Thus, for example, lever 8 can control height and swivel, swivel and translation with respect to the pedestal, or translation and height without departing from the spirit of the invention.

The foregoing disclosure and description of the invention are illustrative and explanatory thereof, and various changes in the size, shape, and materials, as well as in the details of the illustrated construction, may be made without departing from the spirit of the invention from the spirit of the invention.

We claim:

1. A pedestal assembly for a seat, comprising:

a base;

a tube having a longitudinal axis, said tube is moveably supported on to said base;

a seat mount supported by said tube;

a support member connected to the seat and movably mounted to said seat mount;

a single lever on said seat mount and movable with respect to said tube and said support member into a plurality of position to accomplish at least two of the following movements:

movement of said tube along its longitudinal axis, when the lever engages an actuating pin of a power cylinder which interconnects the base and the tube rotation of said seat mount about said longitudinal axis of said tube, when the lever disengages a recess in the tube, and translation of said support with respect to said seat mount when the lever disengages engagement grooves from a locking member of said support;

said lever selectively preventing at least one of said movements while preventing at least one of said movements by occupying one of said plurality of positions;

said lever directly selectively preventing at least one of said movements; in one of said positions.

2. The assembly of claim 1, further comprising:

said lever accomplishing all of said movements.

3. The assembly of claim 2, wherein:

said support member is slidably mounted to said seat mount.

4. The assembly of claim 3, wherein:

said support member comprises a movable locking member releasably engageable to said seat mount.

5. At The assembly of claim 4, further comprising:

said lever operably connected to said locking member to selectively prevent it from engagement with said seat mount for said translation of the seat.

6. The assembly of claim 2, further comprising:

said power cylinder supporting said tube;

said lever is operable into a first position to enable said longitudinal movement of said tube by actuation of said power cylinder and in a second position to enable said rotational movement of said seat mount by disengagement from said tube.

7. A pedestal assembly for a seat, comprising:

a base;

a tube having a longitudinal axis, said tube is movably support on said base;

a seat mount supported by said tube;

a support member connected to the seat and movably mounted to said seat mount;

a single lever on said seat mount and movable with respect to said tube and said support member to accomplish at least two of the following movements:

movement of said tube along its longitudinal axis, when the lever engages an actuating pin of a power cylinder which interconnects the base and the tube rotation of said seat mount about said longitudinal axis of said tube, when the lever disengages a recess in the tube, and translation of said support with respect to said seat mount; when the lever disengages engagement grooves from a locking member of said support;

said support member comprises a movable locking member releasably engageable to said seat mount;

said locking member comprises a pivoting bar having at least one tooth; and said seat mount comprises at least one groove to selectively engage said tooth upon selective operation of said lever.

8. The assembly of claim 7, further comprising:

a cam on said seat mount engageable by said lever when said lever is moved to one of its distinct positions said cam thus selectively a plunger to prevent entry of said tooth into said groove.

9. The assembly of claim 8, further comprising:

said plunger on said seat mount actuated by said cam to enter said groove and in turn preclude said tooth from being in said groove.

10. The assembly of claim 7, wherein:

said bar is spring-loaded to urge said tooth toward said groove.

11. The assembly of claim 10, wherein:

said bar comprises a plurality of teeth to allow engagement of said support member to said seat mount in a plurality of positions in a plane perpendicular to said longitudinal axis.

12. The assembly of claim 11, wherein:

said bar comprises an extending segment which extends beyond one end of said support member so as to make said bar operable by said lever and by said extending segment.

13. The assembly of claim 12, wherein:

said bar is mounted to pivot in a plane substantially perpendicular to said longitudinal axis, while said lever is movable to pivot in a plane substantially parallel to said longitudinal axis.

14. A pedestal assembly for a seat, comprising:

a base;

a tube having a longitudinal axis, said tube is movably supported on said base;

a seat mount supported by said tube;

a support member connected to the seat and movably mounted to said seat mount;

a single lever on said seat mount and movable with respect to said tube and said support member to accomplish the following movements:

movement of said tube along its longitudinal axis, when the lever engages an actuating pin of a power cylinder which interconnects the base and the tube rotation of said seat mount about said longitudinal axis of said tube, when the lever disengages a recess in the tube and translation of said support with respect to said seat mount; when the lever disengages engagement grooves from a locking member of said support;

said lever accomplishing all of said movements;

said power cylinder supporting said tube;

said lever is operable into a first position to enable said longitudinal movement of said tube by actuation of said power cylinder and in a second position to enable said rotational movement of said seat mount by disengagement from said tube;

said lever is operable in a third position where it does not actuate said power cylinder and where it is rotationally locked to said tube such that longitudinal movement of said tube and rotation of said seat mount cannot occur;

said third position is between said first and second positions;

said first, second, and third positions are reached by movement of said lever in a plane substantially parallel to said longitudinal axis;

said lever movable into a fourth position in the same direction and beyond said second position to disengage said support member from said seat mount for translation of said support member with respect to said seat mount.

15. The assembly of claim 14, further comprising:

a biasing device on said seat mount to bias said lever to said third position.

16. The assembly of claim 15, wherein:

said tube further comprises at least one recess thereon;

said lever comprising an end which extends through said seat mount and into said recess when said lever is in its said third position, said lever end moving out of said recess when said lever is moved to said second position.

17. The assembly of claim 16, wherein:

said power cylinder connecting said base to said tube and having an actuating pin mounted to said cylinder;

said lever end disposed adjacent said actuating pin without actuation thereof when said lever is in said third position, said lever end actuating said pin when said lever is in said first position to allow said tube to be raised and lowered with respect to said base.

18. The assembly of claim 17, wherein:

said lever end pivots within said recess to reach its said first position from said third position.

* * * * *